US005136333A

United States Patent [19]

Craft et al.

[11] Patent Number: 5,136,333

[45] Date of Patent: Aug. 4, 1992

[54] ELECTROPHOTOGRAPHIC PRINTER AND CARTRIDGE ARRANGEMENT

[75] Inventors: James A. Craft, Lexington; William L. Dollenmayer, Versailles; James P. Harden, Lexington; Frank M. Hughes, Paris; James J. Molloy, Lexington, all of Ky.

[73] Assignee: Lexmark International, Inc., Greenwich, Conn.

[21] Appl. No.: 374,685

[22] Filed: Jun. 30, 1989

[51] Int. Cl.[5] ..... G03G 15/00

[52] U.S. Cl. ..... 355/211; 355/200

[58] Field of Search ..... 355/200, 211, 210, 245, 355/260; D18/43

[56] References Cited

U.S. PATENT DOCUMENTS

| | | | |
|---|---|---|---|
| D. 309,323 | 7/1990 | Craft et al. | D18/40 |
| 4,386,841 | 6/1983 | Wakao et al. | 355/200 |
| 4,556,308 | 12/1985 | Hoppner et al. | 355/200 |
| 4,634,264 | 1/1987 | Takahashi | 355/200 |
| 4,668,072 | 5/1987 | Yusuda | 355/211 |
| 4,748,481 | 5/1988 | Kunihiro | 355/200 X |
| 4,803,511 | 2/1989 | Izzo | 355/211 |
| 4,862,212 | 8/1989 | Tanzawa et al. | 355/245 |
| 4,873,548 | 10/1989 | Kobayashi et al. | 355/200 |
| 4,876,572 | 10/1989 | Nagatsuna | 355/210 |
| 4,943,815 | 7/1990 | Aldrich et al. | 355/210 X |

FOREIGN PATENT DOCUMENTS

| | | | |
|---|---|---|---|
| 2611930 | 9/1988 | France . | |
| 0198171 | 9/1986 | Japan | 355/200 |
| 0043164 | 2/1988 | Japan . | |
| 0049056 | 2/1989 | Japan . | |

*Primary Examiner*—Joan H. Pendegrass
*Assistant Examiner*—Robert Beatty
*Attorney, Agent, or Firm*—John J. McArdle, Jr.

[57] ABSTRACT

An electrophotographic printer (11) having a base (13) and a top (12), the top (12) being pivotable about an axis (23) between a closed position and an open position. The printer (11) receives a supply cartridge (14) on a shelf (22) which is pivotable about the same axis (23) as the top (12) of the printer (11). A counterbalance spring (34) helps to support the shelf (22) and the cartridge (14) below the top (12) of the printer (11) and above the printer base (13) when the top (12) of the printer (11) is in its open position. When the top (12) of the printer (11) is closed, the cartridge (14) is urged into a position adjacent the printer base (13) and locked into an operative position.

6 Claims, 5 Drawing Sheets

ELECTROPHOTOGRAPHIC PRINTER AND CARTRIDGE ARRANGEMENT

DESCRIPTION OF THE INVENTION

1. Field of the Invention

This invention relates generally to electrophotographic printers which utilize an electrophotographic supply cartridge therein. In one of its aspects, the invention more particularly concerns the manner of mounting such a supply cartridge in a printer. In other aspects, the invention concerns printers employing such cartridge mounting means and cartridges structured to cooperate with certain cartridge mounting means.

2. Description of the Prior Art

In many electrophotographic printers, access to the interior of the printer is provided by permitting movement of one portion of the printer relative to another portion. For example, at the front of a printer, an upper portion of the printer may be raised relative to a lower portion. This may be accomplished by pivoting the upper portion about a horizontal axis along the back of the printer where the upper and lower portions of the printer meet. A suitable counterbalance force is usually provided to assist in raising the upper portion of the printer and maintaining it in a raised, or open, position. Such access to the interior of the printer is useful for replacement of supply items such as electrophotographic toner or a photoconductor. Such access also facilitates the clearing of paper jams within the printer.

In such printers, supply cartridges are often used to facilitate the replacement of supply items. For example, in some cases an electrophotographic toner cartridge may be used in the printer. In other cases, a supply cartridge might contain not only toner but also a photoconductor drum and cleaning blade.

Some such cartridges, such as those containing several supply items, may have considerable size and weight. If the cartridge is mounted in the lower portion of the printer, the cartridge may need to be removed from the printer in order to permit access to the entire paper path for clearing paper jams. The cartridge may alternatively be mounted in the upper portion of the printer. In some cases, however, the cartridge cannot be mounted in the upper portion of the printer due to space limitations. Or, if the supply cartridge can be mounted in the upper portion of the printer, removing and replacing the cartridge can be difficult, such as when a laser printhead is mounted in the upper portion of the printer and the supply cartridge is shaped to fit around the printhead.

It is the general aim of the invention to provide a printer cartridge mounting, and a supply cartridge, arrangement in electrophotographic printers of the foregoing type in which the supply cartridge is not mounted in the upper portion of the printer, and yet the cartridge does not obstruct access to the lower portion of the printer when the upper portion of the printer is in an open position.

SUMMARY OF THE INVENTION

In accordance with one aspect of the invention, in an electrophotographic printer having a lower portion, or base, and an upper portion, or top, which is pivotable about an axis between a closed position and an open position, there is provided a support for a supply cartridge in the printer which includes a shelf pivotable about an axis and means for applying a force to maintain the shelf and a cartridge thereon below the top of the printer and also above the base of the printer when the top of the printer is in its open position.

In one embodiment of the invention, the support takes the form of a shelf pivotable about the same axis as the top of the printer, with the force to maintain the shelf being supplied in part by a counterbalance spring which is also positioned along this axis.

In accordance with another aspect of the invention, an electrophotographic printer and cartridge arrangement is provided which includes a printer having a base and a top, with the top being pivotable about an axis between a closed position and an open position, a shelf for supporting a cartridge mounted in the printer and pivotable about an axis, means for applying a counterbalance force to the shelf sufficient to space the shelf and the cartridge thereon above the base when the top is in its open position, the shelf including lateral end plates defining slots, and a cartridge, supported on the shelf, having lugs received in the slots in the end plates of the shelf.

In accordance with yet another aspect of the invention, there is provided a supply cartridge for an electrophotographic printer having a housing containing a photoconductor drum, toner particles, and a roll for applying toner particles to develop an electrostatic image on the photoconductor drum. The cartridge housing includes a pair of side walls and axles extending outwardly from the side walls on the axis of rotation of the photoconductor drum. The axles are adapted to be locked in place in an electrophotographic printer in which the cartridge is received. The side walls of the cartridge further include a pair of lugs lying on an axis parallel to the photoconductor drum axis and spaced apart therefrom, the lugs extending outwardly from the side walls of the cartridge and being adapted to be received in slots in a load shelf in an electrophotographic printer.

Other objects and advantages of the invention, and the manner of their implementation, will become apparent upon reading the following detailed description and upon reference to the drawings, in which:

Figure 1:
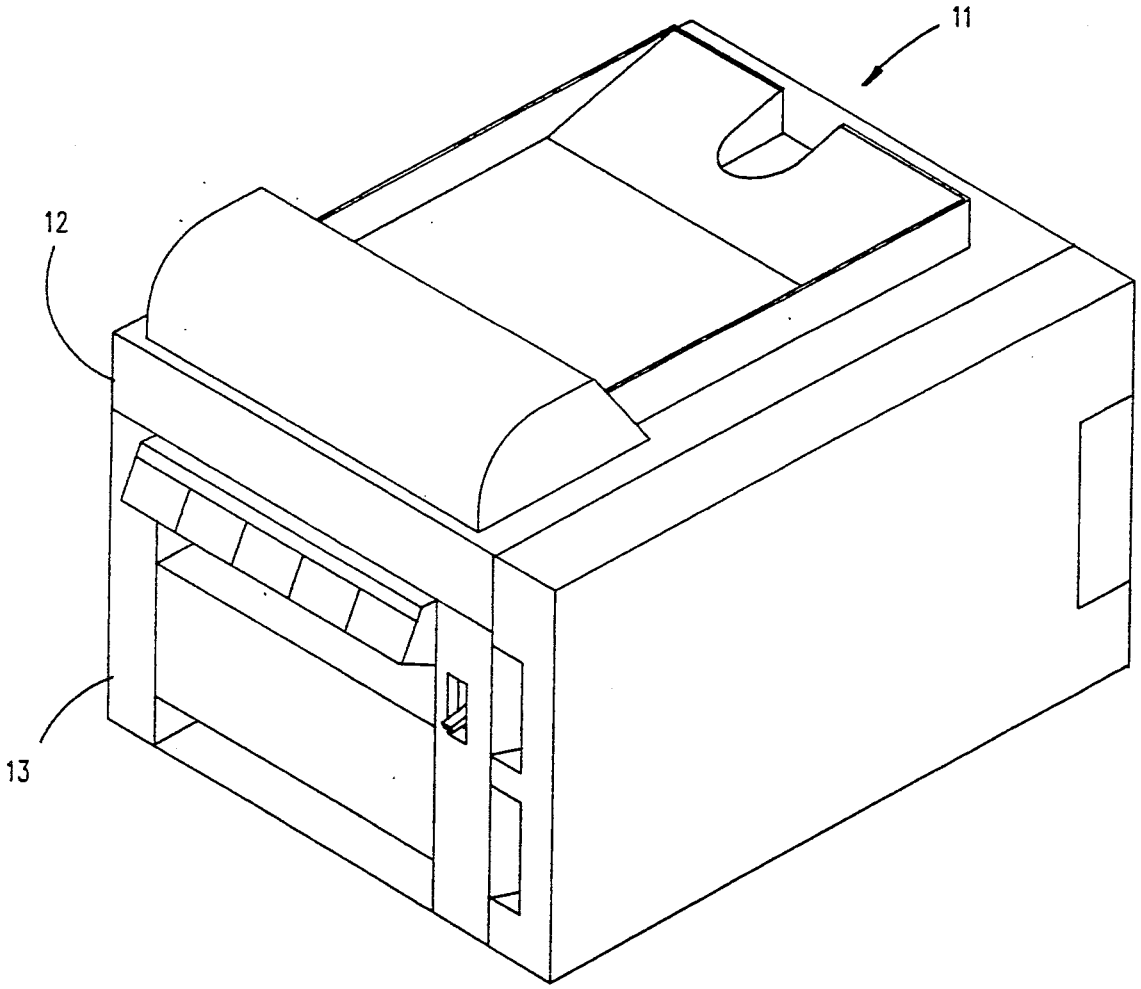
FIG. 1 is a perspective view of an electrophotographic printer.

While the invention is susceptible to various modifications and alternative forms, a specific embodiment thereof has been shown by way of example in the drawings and will herein be described in detail. It should be understood that it is not intended to limit the invention to the particular form disclosed, but the intention is to cover modifications, equivalents and alternatives falling within the spirit and scope of the invention as defined by the appended claims.

DESCRIPTION OF THE PREFERRED EMBODIMENT

With reference now to the figures, an electrophotographic printer 11 includes an upper portion (hereinafter, "top") 12 and a lower portion (hereinafter, "base") 13. The top 12 is pivotable about a shaft 23 to an open position relative to the base 13 to permit access to the interior of the printer. A supply cartridge 14 is removably supported within the printer 11 as shall be described in more detail subsequently.

Figure 7:
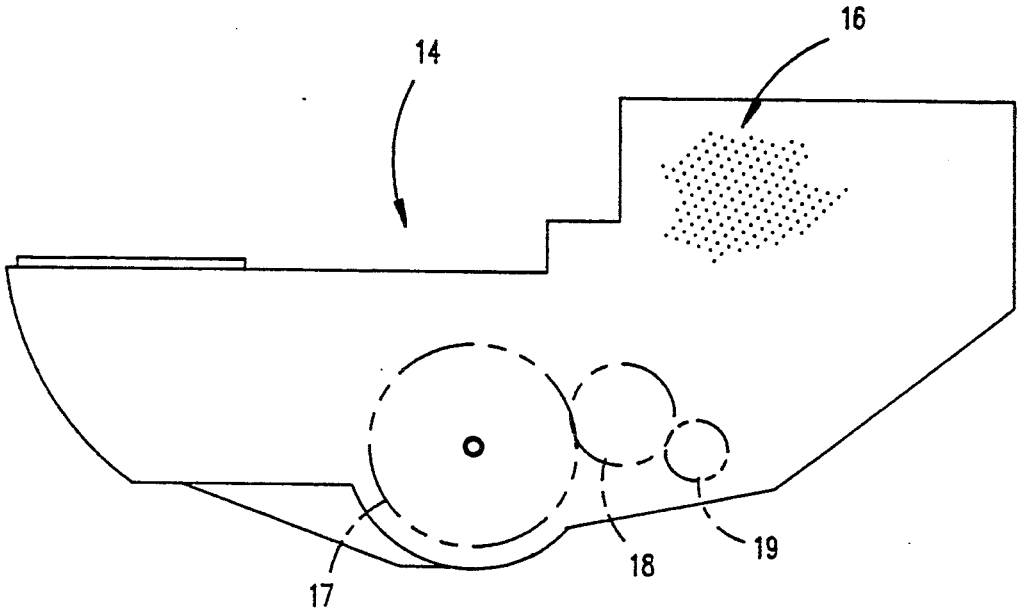
FIG. 7 is a diagrammatic side view of the cartridge of FIG. 4 showing some of the contents of the cartridge.

The cartridge 14, in the particular printer illustrated, includes (FIG. 7) toner 16, a photoconductor drum 17, and rolls 18, 19 for developing an electrostatic image on the photoconductor drum by applying toner to the drum.

Figure 2:
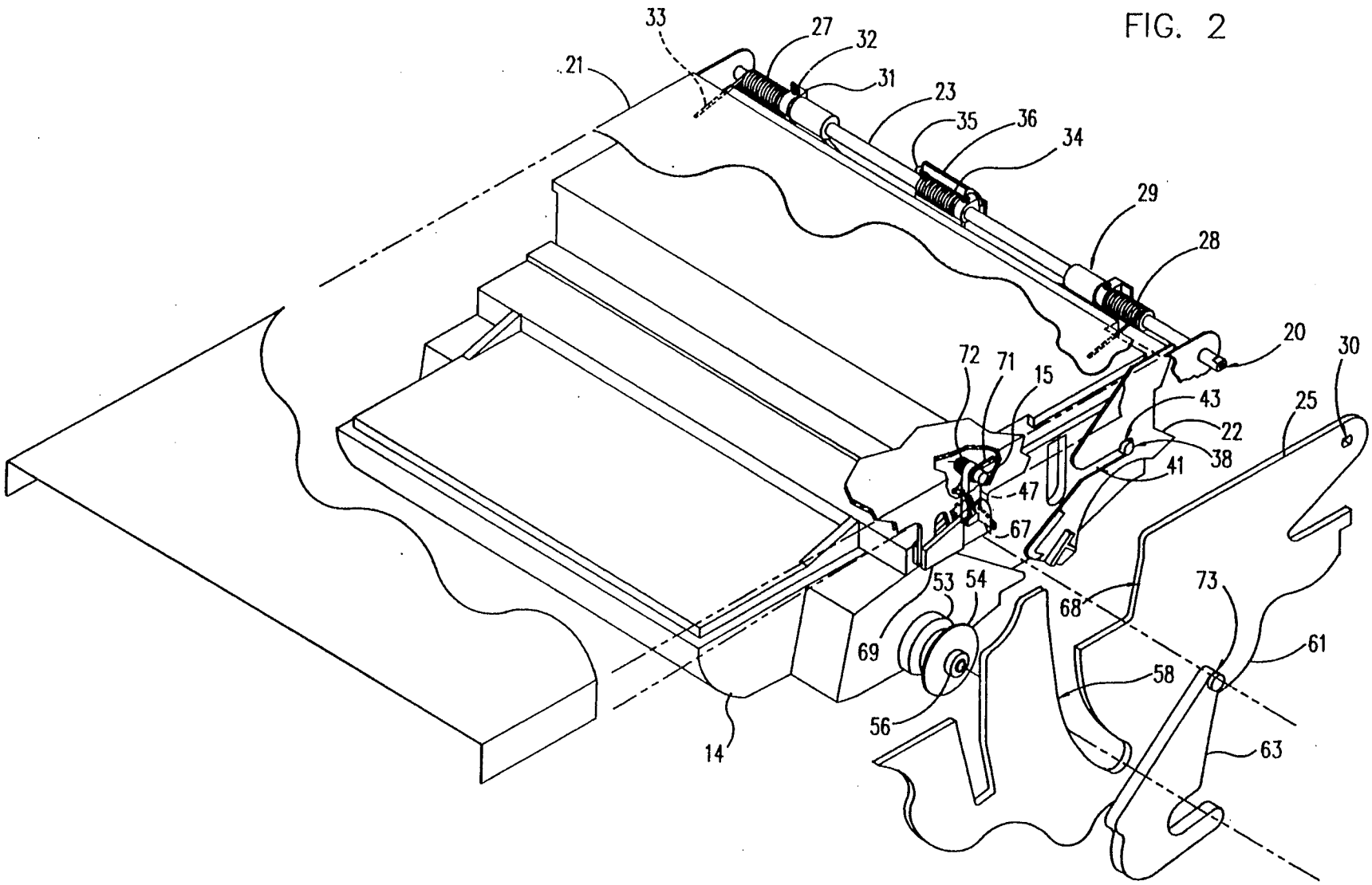
FIG. 2 is a partially exploded perspective view of a supply cartridge, supporting shelf and portions of the electrophotographic printer of FIG. 1.
Figure 4:
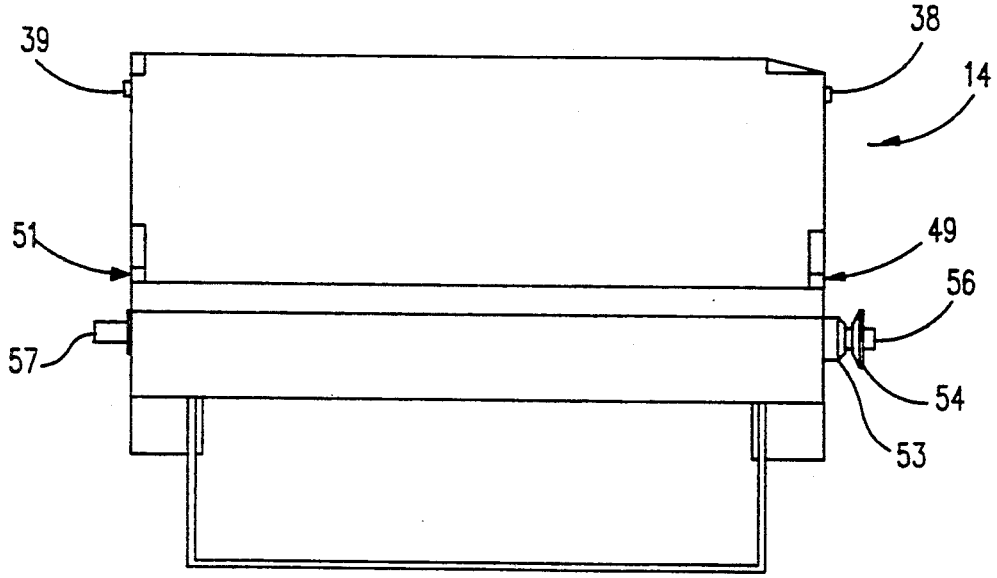
FIG. 4 is a top plan view of the cartridge of FIGS. 2 and 3.
Figure 3:
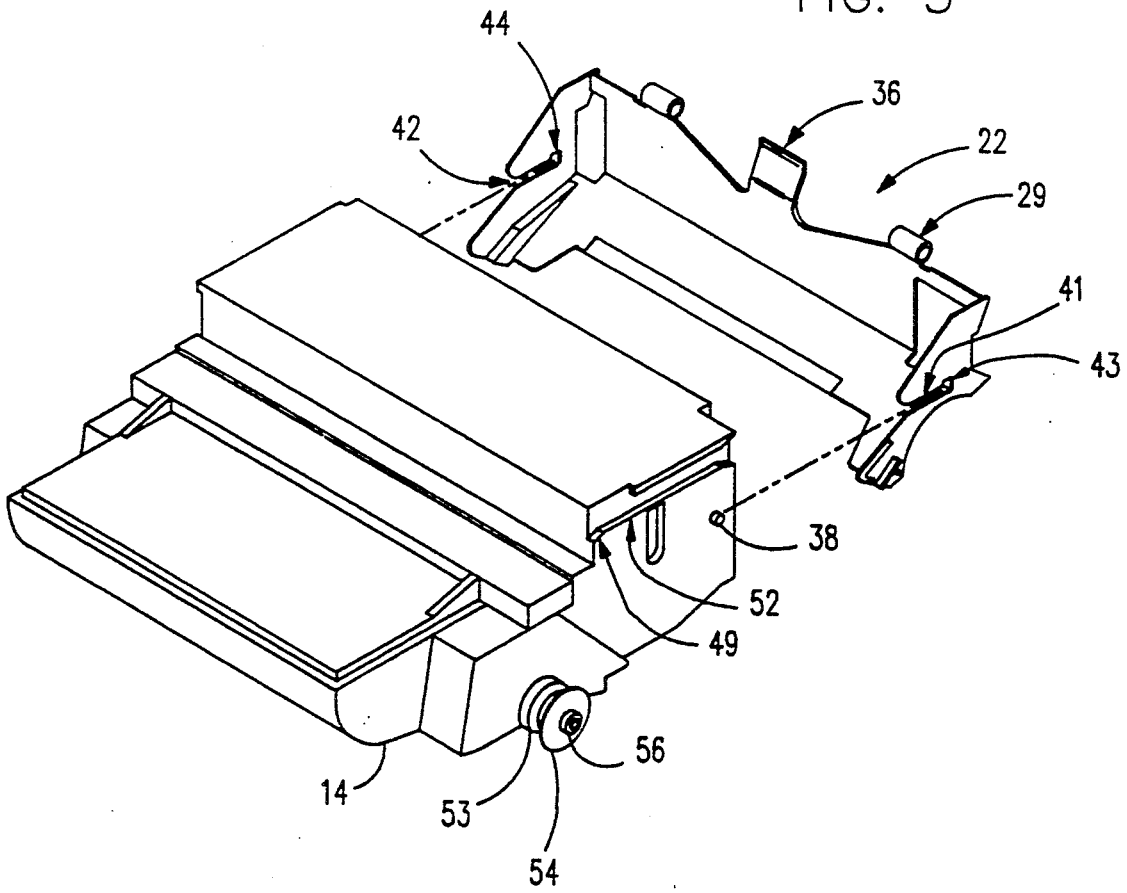
FIG. 3 is a perspective view of the cartridge and shelf of FIG. 2, showing the cartridge removed from the shelf.

The principal structural components of the top of the printer and the cartridge support are a top plate 21 and a load box, or shelf, 22. The top plate 21 and the shelf 22 both pivot about a shaft 23. The shaft 23 is mounted in the base 13 of the printer by securing each end of the shaft to a side plate 25 (one of which is shown in FIG. 2). Each end of the shaft 23 has flats received in a correspondingly-shaped opening 30 in each side plate 25 and held therein by a screw (not shown) inserted into an opening 20 in the end of the shaft. The shaft 23 is received in collars such as 29 on the shelf 22.

To open the printer, the top 12 (including the top plate 21) is raised to a position about 70° from horizontal. At this time, the top plate 21 is at this 70° angle. When the top plate 21 is raised, rear tabs such as 24 (FIG. 8) on the top plate 21 contact the load shelf 22 after about 30° of rotation of the top plate 21. The rotation of these tabs applies forces to contacted surfaces such as 26 on the ends of the shelf 22 to aid in raising the shelf 22, and the cartridge 14 held thereon, to its "load" position, which is about 40° from the horizontal, or closed, position. Therefore, when the top of the printer is opened, the cartridge and the shelf are positioned between the top of the printer and the base of the printer to facilitate removal and replacement of the cartridge 14.

Torsional springs 27, 28 counterbalance the top 12 of the printer, including the top plate 21, and hold it in its open position when the top 12 of the printer is raised. The torsional spring 27 is mounted on the shaft 23, with one end secured to a stop 31 which is in turn secured to the shaft by a screw 32. The other end 33 of the spring 27 bears against the top plate 21 to provide the counterbalance force. The spring 28 is similarly mounted on and attached to the shaft 23 and also has a free end applying counterbalance force to the top plate 21.

An additional torsion spring 34 helps to counterbalance the weight of a cartridge and the load shelf 22 and to hold the load shelf in its cartridge-loading and unloading position (at about 40° from horizontal). The spring 34 is secured at one end to the shaft 23 in the same manner as the springs 27 and 28, and has a free end 35 bearing against a portion 36 of the load shelf 22. The two sets of torsion springs (27, 28 and 34) work independently of one another to assure that an operator opening the top 12 of the printer feels no significant difference in resistance in opening and closing the printer with or without a supply cartridge 14 held on the shelf 22.

If the top of the printer is closed with no cartridge 14 on the load shelf 22, the load shelf remains in its "load" position at about 40° from horizontal. In this case, the spring 34 holds the load shelf in its "load" position, and the top plate of the printer does not contact the load shelf when the top of the printer is closed.

In order to load a cartridge 14 into the printer, it is only necessary to insert the cartridge into the shelf 22. In doing this, detent lugs 38, 39 on each side of the cartridge 14 slide into slots 41, 42 of the load shelf 22. When the cartridge 14 is released, the weight of the cartridge rotates the detent lugs 38 upwardly and slightly forward into a locked position in enlarged areas 43, 44 in the slots 41, 42.

After the cartridge 14 is loaded, closing the top 12 of the printer, including the top plate 21, moves the cartridge into its operating position within the printer and locks it in place. This movement of the cartridge is at the outset accomplished by left and right bellcranks, or pivotable arms, such as 47 pivotally attached to the top plate 21. The arm 47 is pivotally mounted on a pin 15 staked to the top plate 21, and the arm 47 is rotatable about the pin. The arm 47 applies a downward force at location 49 on a ledge 52 on the cartridge 14 as the top of the printer is closed. An arm similar to the arm 47 applies a downward force to a corresponding location 51 on the other side of the cartridge 14. As these arms 47 force the cartridge down, axles 56, 57 on either side of the cartridge are guided into and through slots such as 58 in side plates such as 61 of the printer. The printer base 13 includes a side plate in each side of the printer.

The axle 57 of the cartridge 14 moves within a slot in a side plate paralleling the slot 58 in the side plate 61 in which the axle 56 moves. The axles 56, 57 are aligned with the axis of the photoconductor drum in the cartridge 14, although the axles are fixed and do not rotate with the photoconductor drum. In the case of the axle 56, increased diameter portions 53, 54 define a portion of the axle which is received in side plate slot 58. The increased diameter portions locate the cartridge 14 laterally in the printer by locating the axle relative to the side plate 61.

As the axles 56, 57 descend in their respective slots such as 58, they engage locking latch members such as 63, which are pivotally mounted on the side plates such as 61.

Figure 5:
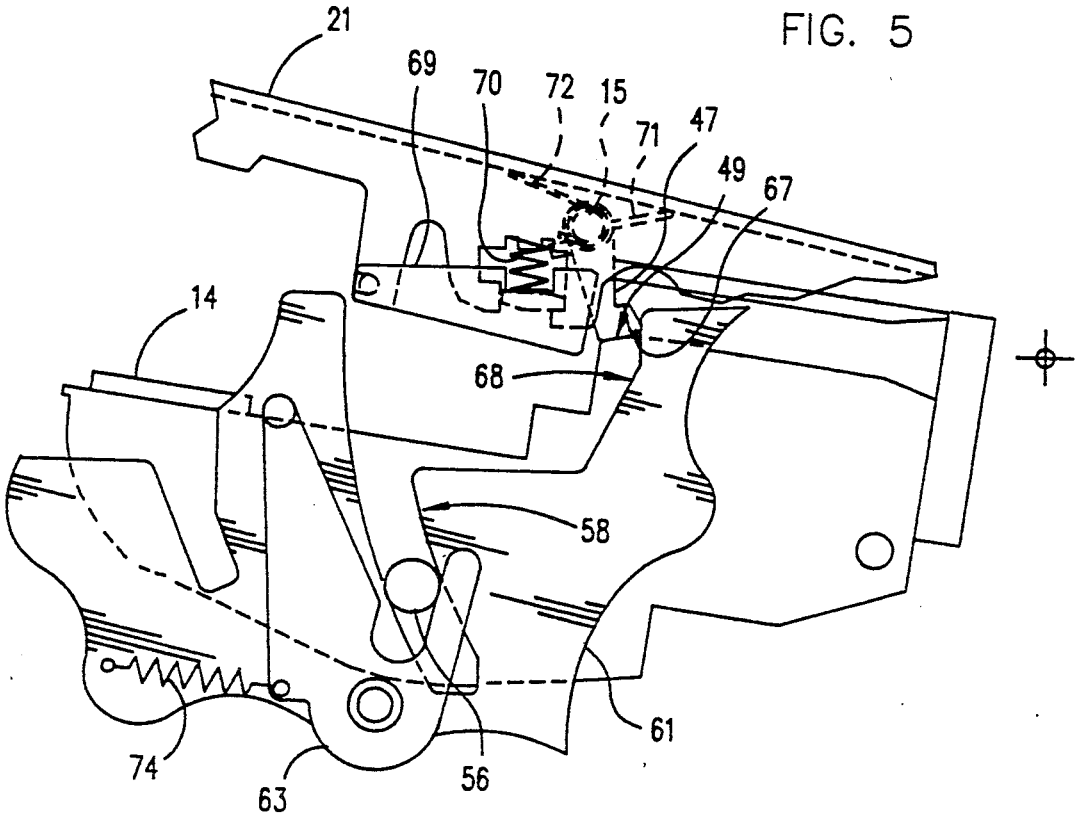
FIG. 5 is a partially diagrammatic side view of the movement and latching components of FIG. 2 with the printer top in a partially open position.
Figure 6:
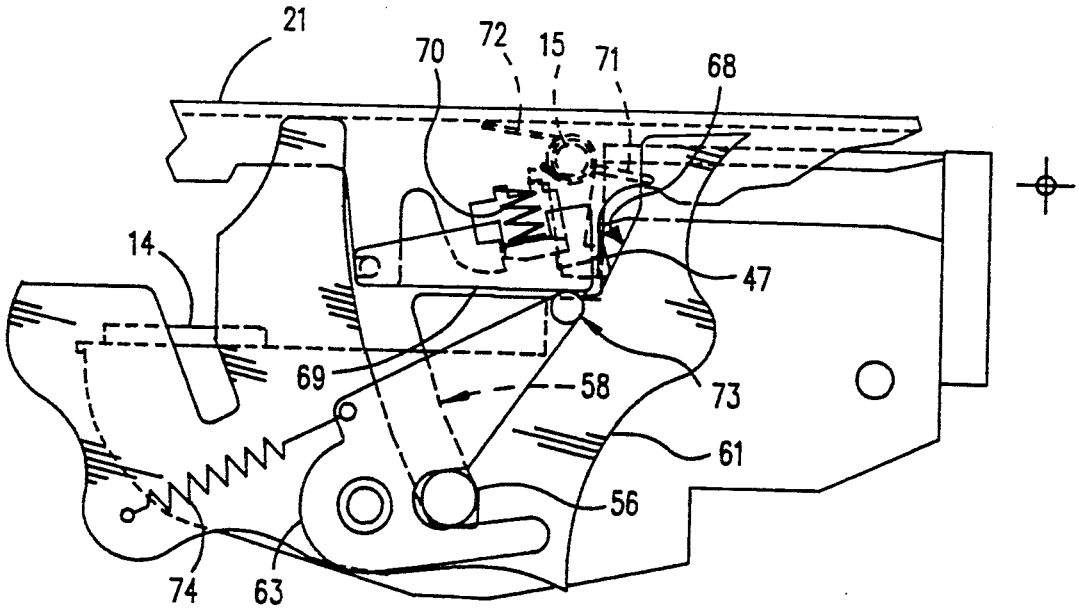
FIG. 6 is a partially diagrammatic side view of the movement and locking components of FIG. 2 with the printer top in a closed position.

The latch members 63 are rotated by the descending axles 56, 57 so that they rotate clockwise as shown in FIGS. 5 and 6. In FIG. 5 the top plate 21 has been lowered to the point that the arms 47 have begun pushing the cartridge 14 into the base of the printer. The construction is such that, as the cartridge and axles move downwardly, the locking latch members 63 are rotated nearly to a final position by the urging of the arms 47 (acting through the cartridge) forcing the axles downward in the slots.

Prior to fully locking the axles of the cartridge 14 in the printer, the pivotable arms 47 are cammed from engagement with the cartridge 14 as flanges 67 on the pivotable arms move along angled surfaces 68 on the side plates 61 of the printer. At the same time, cam buttons, or latch plates, 69, which are attached to the top plate 21 under spring loading, engage long arm portions 73 of the latch members 63 and further rotate them to a final position. This insures that the cartridge axles 56, 57 are fully at the bottom of their respective slots in the side plates and that the cartridge is locked into position.

Since gear teeth (not shown) on the cartridge 14 and in the base of the printer must mesh when the cartridge is in an operable position in the printer, the possibility of the gear teeth on the cartridge and gear teeth in the printer initially meeting "tooth-to-tooth" as the cartridge is locked in must be accommodated. This is accomplished by the spring loading of the cam buttons 69, which can yield sufficiently to allow for such tooth-to-tooth engagement of the gears. When the printer is subsequently operated, the drive gears in the printer rotate and the gear teeth on the cartridge then mesh with the printer gears and are held there under the loading of springs 70 on the cam buttons.

Removing a cartridge is accomplished by simply reversing the process. Opening the top of the printer resets the pivotable arms 47, which are rotated back to a rest position. With the top of the printer open, the arm 47 is in the rest position when a stop 71 on the arm is held against the top plate 21 under the influence of a spring 72. The spring 72 is secured at one end to the arm 47 and has a free end contacting the top plate 21, tending to urge the arm 47 counterclockwise as viewed in FIG. 5.

Figure 8:
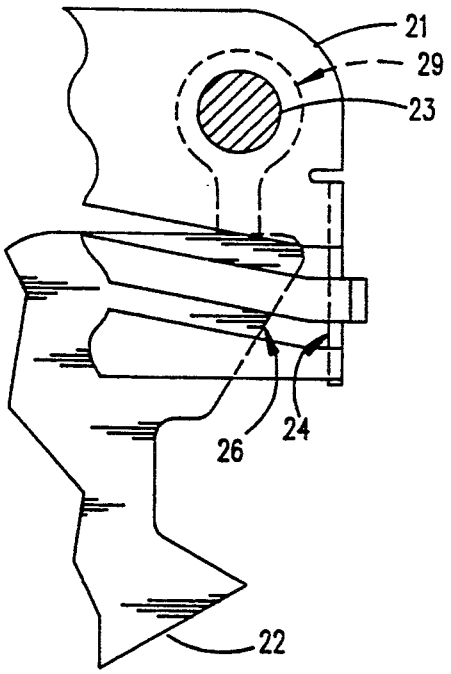
FIG. 8 is an enlarged side view of a portion of the printer of FIG. 2 showing the contact points between the cartridge shelf and the top plate of the printer.

The latch member 63 is also returned to its rest position by a spring 74 acting between the latch member and the side plate 61. The load shelf 22 and the cartridge 14 therein are urged to the load position (40° from horizontal) by the counterbalance spring 34 and as a result of the tabs 24 on the top plate 21 acting on the surfaces 26 on the load shelf 22 (FIG. 8).

What is claimed is:

1. An electrophotographic printer and cartridge arrangement comprising:

a printer base;

a printer top pivotable about an axis between a closed position and an open position;

a supply cartridge having lateral ends, each end including a lug portion;

a shelf separate from the printer top mounted in the printer and pivotable about an axis for supporting the supply cartridge below the top of the printer when it is in its open position, the shelf having a pair of side walls, each including a slot which receives one of the lug portions on the cartridge; and means for applying a counterbalance force to the shelf and the cartridge sufficient to space the shelf and the cartridge thereon below the top and above the base when the top is in its open position, the cartridge being urged into a position adjacent the base when the top is moved to its closed position;

in which (a) the top of the printer includes two pivotable arms positioned to contact the supply cartridge as the top of the printer is moved to its closed position, (b) each lateral end of the cartridge includes an axle extending therefrom, and (c) the printer includes two side plates, each of which includes a slot through which a different one of the cartridge axles moves as the cartridge is urged into a position adjacent the base;

and in which the printer side plates each include a latch pivotably mounted thereon positioned to be contacted by an axle of the cartridge and moved to a partially latched position by the axle as it moves through the side plate slot when the cartridge is urged into a position adjacent the base.

2. The arrangement of claim 1 in which each side plate of the printer includes a cam surface contacting a different one of the two pivotable arms on the top of the printer as the top of the printer is moved to its closed position, each of the pivotable arms applying a downward force to the cartridge to urge the cartridge into a position adjacent the base of the printer as the top of the printer is moved to its closed position.

3. The arrangement of claim 2 in which the top of the printer further includes two latch plates, each positioned to contact a different one of the side plate latches and urge it into a latched position during the final movement of the top of the printer to its closed position.

4. The arrangement of claim 3, in which the cam surfaces in the side plates of the printer are shaped to pivot the pivotable arms on the printer top out of contact with the supply cartridge prior to the final movement of the top of the printer to its closed position.

5. A supply cartridge for an electrophotographic printer adapted to be received on a support shelf in a printer comprising a cartridge housing containing (a) a photoconductor in the form of a generally cylindrical drum having an axis of rotation, (b) toner particles, and (c) a roll for applying toner to the photoconductor drum to develop an electrostatic image thereon, the housing having two side walls and having two axles extending from the side walls and lying generally along the axis of rotation of the photoconductor drum, one of the axles including two spaced-apart increased diameter portions to facilitate locating the cartridge laterally in a printer, and also having two lug portions extending from the side walls of the cartridge spaced apart from the cartridge axles and lying along an axis extending through the cartridge parallel to the axis of the photoconductor drum, the axles being adapted to be locked in place in an electrophotographic printer and the lug portions being adapted to be received in slots on a shelf in an electrophotographic printer for supporting the cartridge, the housing further having a ledge on each side wall above and between the axle and the lug with each ledge having a location for the application of a downward force by a top of an electrophotographic printer.

6. An electrophotographic printer and cartridge arrangement comprising:

the cartridge of claim 5;

a printer base;

a printer top pivotable about an axis between a closed position and an open position;

a shelf separate from the printer top mounted in the printer and pivotable about an axis for supporting the supply cartridge below the top of the printer when it is in its open position, the shelf having a pair of side walls, each including a slot which receives one of the lug portions on the cartridge;

means for applying a counterbalance force to the shelf and the cartridge sufficient to space the shelf and the cartridge thereon below the top and above the base when the top is in its open position; and means for urging the cartridge to a position adjacent the base when the top is moved to its closed position including arms on the printer top positioned to engage the locations on the ledge on the side walls of the cartridge to apply downward forces thereto when the printer top is moved to its closed position.

* * * * *